US005681044A

United States Patent [19]

Houriet, Jr. et al.

[11] Patent Number: 5,681,044

[45] Date of Patent: Oct. 28, 1997

[54] METHOD AND APPARATUS FOR CONTROLLING CRICKET-BASED DART GAME

[75] Inventors: John W. Houriet, Jr., Yardley; Peter Feuer, Rydal; John C. Nydick, Havertown, all of Pa.

[73] Assignee: Merit Industries, Inc., Bensalem, Pa.

[21] Appl. No.: 579,558

[22] Filed: Dec. 27, 1995

[51] Int. Cl.[6] ..... F41J 5/04

[52] U.S. Cl. ..... 273/371

[58] Field of Search ..... 273/371, 376, 273/372, 374; 463/7, 1, 23; 434/11, 15, 19

[56] References Cited

U.S. PATENT DOCUMENTS

| | | | |
|---|---|---|---|
| 4,057,251 | 11/1977 | Jones et al. | 273/95 R |
| 4,427,199 | 1/1984 | Faith | 275/371 |
| 4,516,781 | 5/1985 | DeVale et al. | 273/373 |
| 4,793,618 | 12/1988 | Tillery et al. | 273/376 |
| 4,881,744 | 11/1989 | Hansen | 273/376 |
| 4,948,148 | 8/1990 | Danielson | 273/408 |
| 4,974,857 | 12/1990 | Beall et al. | 273/371 |
| 4,976,441 | 12/1990 | Kim | 273/376 |
| 5,020,806 | 6/1991 | Martin | 273/371 |
| 5,116,063 | 5/1992 | Harlan et al. | 273/376 |
| 5,156,643 | 10/1992 | Grubek | 273/376 |
| 5,318,319 | 6/1994 | Jones et al. | 273/371 |
| 5,401,033 | 3/1995 | Lychock, Jr. | 273/371 |
| 5,470,078 | 11/1995 | Conlan | 434/11 X |
| 5,509,650 | 4/1996 | MacDonald . | |

*Primary Examiner*—Jessica Harrison
*Assistant Examiner*—Michael O'Neill
*Attorney, Agent, or Firm*—Panitch Schwarze Jacobs & Nadel, P.C.

[57] ABSTRACT

A dart game controller and method of controlling a dart game is provided wherein a dart board has a plurality of target areas, each target area corresponding to a target value. A preset number of target values are stored in a memory. A mark detector identifies at a predetermined stage of game play which of the target values stored in the memory have been marked at least once by a player, but have not been marked more than a preset number of times by any of the plurality of players. Next, a number generator selects a replacement target value for each identified target value. The replacement target value is stored in the memory in place of the respective previous target value. The target value in the memory for each target value not identified by the mark detector remains unchanged. The method and apparatus is suitable for use in playing a variation of Random Cricket.

22 Claims, 4 Drawing Sheets

METHOD AND APPARATUS FOR CONTROLLING CRICKET-BASED DART GAME

FIELD OF THE INVENTION

The present invention relates generally to dart games and, more particularly to a controller and method of playing a dart game, particularly a dart game which is based on Cricket.

BACKGROUND OF THE INVENTION

FIG. 1 shows a prior art dart board 100. The dart board includes a plurality of pie-shaped beds or target areas numbered 1–20 and a bullseye bed 102. The number associated with each target area represents the score value or target value of each area. Each bed has four segments. For example, the "20" target value bed has segments 104, 106, 108 and 110. In general, in certain dart games, a dart which hits either of the segments 104 or 108 earns a single mark. A dart which hits segment 110 earns a double mark. A dart which hits segment 106 earns a triple mark.

A dart game called Cricket is known wherein players try to hit the bullseye bed 102 and six specific beds numbered 15–20. A player needs three marks to close a bed. At any time, a bed is either "open" or "closed" for a particular player. At the beginning of the game, all beds are "open." A player can close a bed, for example, by hitting either of the segments 104 or 108 three times, by hitting segment 110 once and either of segments 104 or 108 once, or by hitting segment 106 once. When a player closes a bed before another players closes the same bed, each successive mark scored in that bed by the first player to close the bed is added to that player's score, whereas marks from other players in that bed do not count toward anyone's score. If another player subsequently closes the bed which was closed by the first player, subsequent marks by all players, including the first player, do not count toward anyone's score. Thus, the first player to close a bed increases his total score by landing darts in that bed until another player is able to close the bed and stop the first player from accruing more points. While this game has a diverse set of strategies, players are always shooting at the same numbers, and the game can become tiresome because of the lack of variety.

Another known dart game is called Random Cricket. In Random Cricket, prior to the start of the game, six target numbers are randomly generated so that the target numbers do not necessarily correspond to the numbers 15–20. The six target numbers are randomly generated only once prior to the start of the game and remain fixed throughout the play of the game. After the six numbers are randomly generated, the game is played as described above for the conventional Cricket dart board game. Thus, Random Cricket does not provide any more excitement or interest than the conventional Cricket game once the play of the game is started and the target values are fixed.

The random selection in Random Cricket, however, adds variety and additional enjoyment to the game because players must attempt to close the higher target numbers first, thereby gaining maximum advantage over opponents who may only be left with lower scoring target numbers, including values even lower than the normal range of 15–20. Also, since the target numbers available to hit will usually be different from game to game, players have the opportunity to develop skills for shooting repeatedly at a wider range of target values.

Regular Cricket and Random Cricket both present an advantage to players throwing first because they get a chance to throw for and close first the higher point-value targets. In Random Cricket, a player may find his chance of winning markedly reduced by sheer luck, even though the game offers more variety.

To eliminate the disadvantages of random luck and still maintain variety and a degree of uncertainly to the game of Cricket, a variation of Random Cricket was created wherein the target numbers could change during game play. This feature provides a chance to turn the tables on the initial, fixed random selection of target numbers. U.S. Pat. No. 5,401,033 issued to Lychock, Jr. describes this variation. The Cricket dart board game of this patent initially randomly generates the six target numbers, as in Random Cricket. In addition, after each player's turn, the number for each bed that is unhit (i.e., unmarked) by the current or by previous players changes to a new number. The change may be random or in some ordered fashion. The number for each bed that is marked or hit at least once becomes fixed for the remainder of the game. The random generation of target numbers for unmarked beds continues until all of the beds have been marked at least once. After all six beds have been marked at least once, the play of the game continues as in conventional Random Cricket.

In this continuously variable approach, hitting the larger target numbers first to "lock in" the values does not necessarily put succeeding players at a disadvantage because the unmarked numbers remaining may change to a better (i.e., higher) value target number after the player's turn. As a result, further variety, uncertainty and strategic elements arise, thereby increasing the enjoyment of the game.

The continuously variable approach, however, has the disadvantage that one player is able to fix or lock in a previously unlocked number for other players. For example, one player can land one dart in the "singles" segment of a selected low target number and thereby cause the low target number to become locked in for the rest of game play. Hitting the "singles" segment is an event not requiring a high level of skill. Furthermore, it is possible in this version that all target numbers can become locked in after only six dart throws. The game would thus revert to regular Random Cricket at an early stage of play.

The present invention provides a new form of Cricket which does not suffer from the disadvantages of the prior art versions. The version in the present invention introduces new strategic elements by changing target numbers whenever a particular target number is marked at least once, but not closed, after each player's turn. If the player closes the bed, the target number is locked in and no longer changes as game play continues.

SUMMARY OF THE INVENTION

The present invention is directed to a method of controlling a dart game to be played by each of a plurality of players in turn. The dart game has a dart board with a plurality of target areas, each target area corresponding to a target value. The dart game also has a memory for storing a preset number of target values. The method comprises the steps of assigning a first set of target values, storing the first set of target values in the memory, identifying at a predetermined stage of game play target values which have been marked at least once by a player, but have not been marked more than a preset number of times by any of the plurality of players, selecting a replacement target value for each identified target value, and storing the replacement target value for each identified target value in the memory in place of the respective first target value. The target value for each unidentified target value remains unchanged.

Another embodiment of the invention is directed to a controller for a dart game to be played by each of a plurality of players in turn. The dart game has a dart board including a plurality of target areas, each target area corresponding to a target value. The controller comprises a memory for storing a preset number of target values, a mark detector for identifying at a predetermined stage of game play which target values have been marked at least once by a player, but have not been marked more than a preset number of times by any of the plurality of players, and a number generator for generating a replacement target value for each identified target value. The replacement target value is stored in the memory in place of the respective previous target value. The target value in the memory for each target value not identified by the mark detector remains unchanged.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENT

Figure 1:
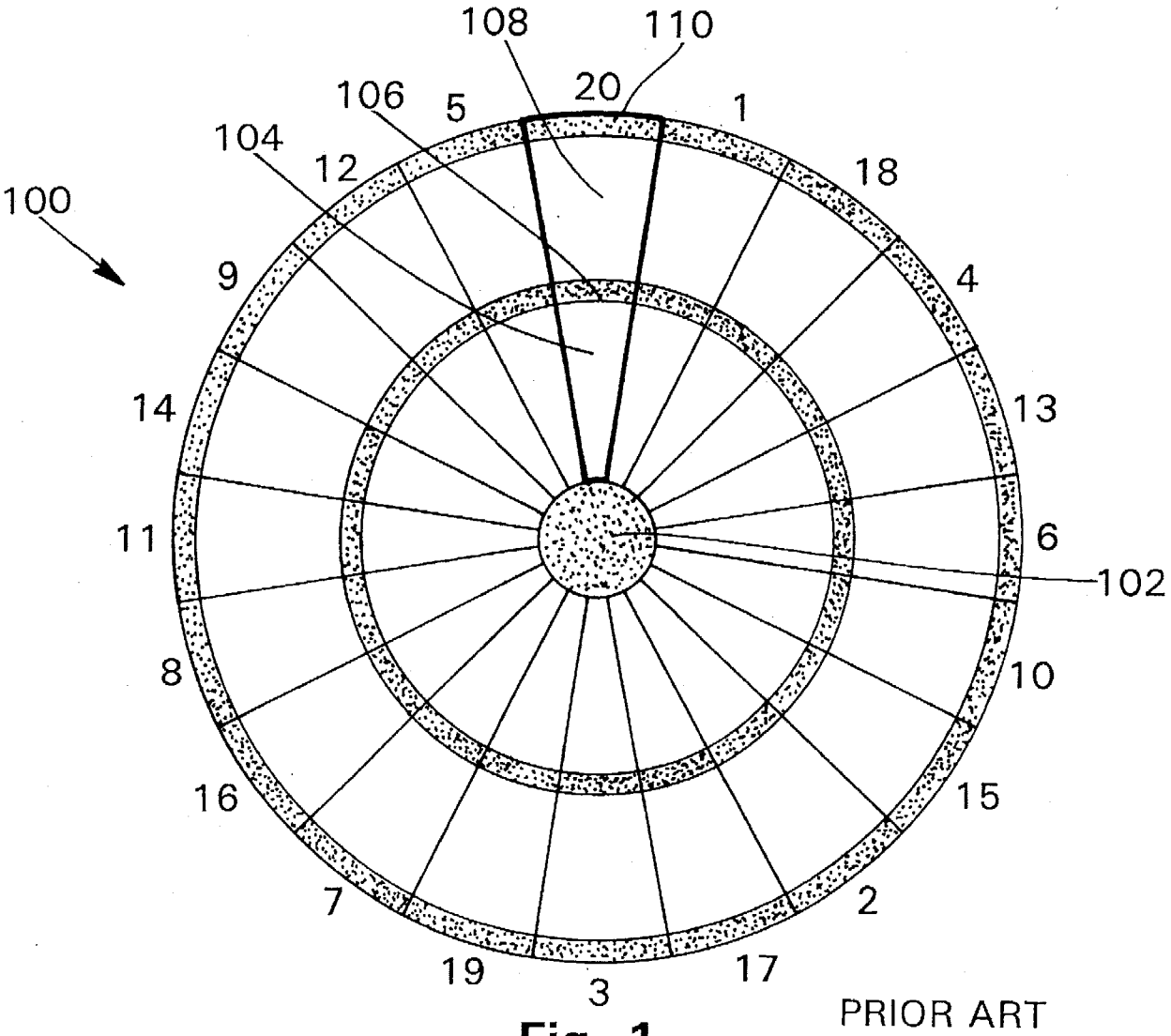
PRIOR ART Fig. 1
FIG. 1 is a front elevational view of a prior art dart board.

Certain terminology is used herein for convenience only and is not be taken as a limitation on the present invention. In the drawings, the same reference numerals are employed for designating the same elements throughout the several figures.

Figure 2:
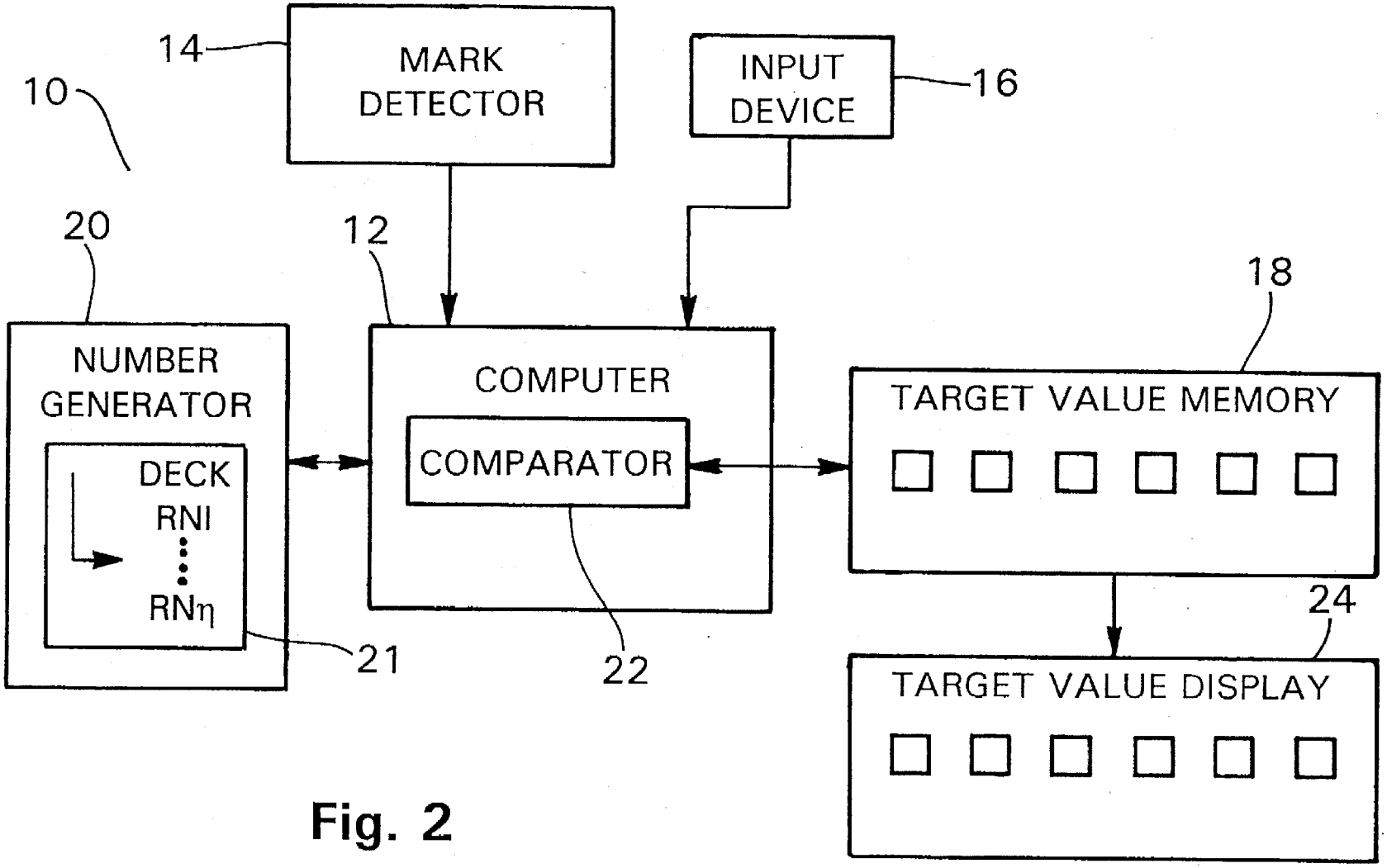
FIG. 2 is a schematic block diagram of a controller in accordance with a preferred embodiment of the present invention.
Figure 3A:
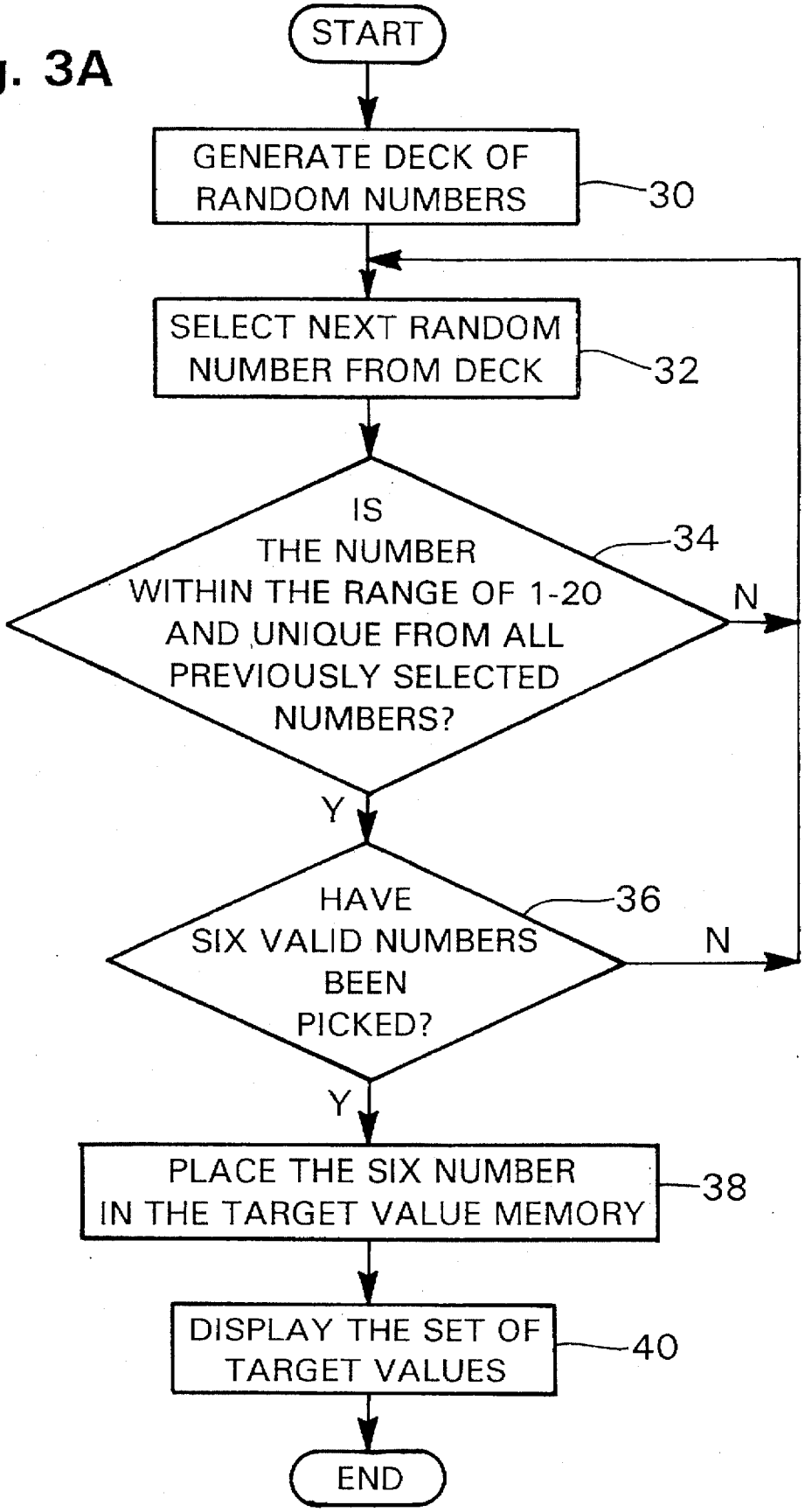
FIGS. 3A and 3B are flowcharts of the operation of the controller of FIG. 2.
Figure 3B:
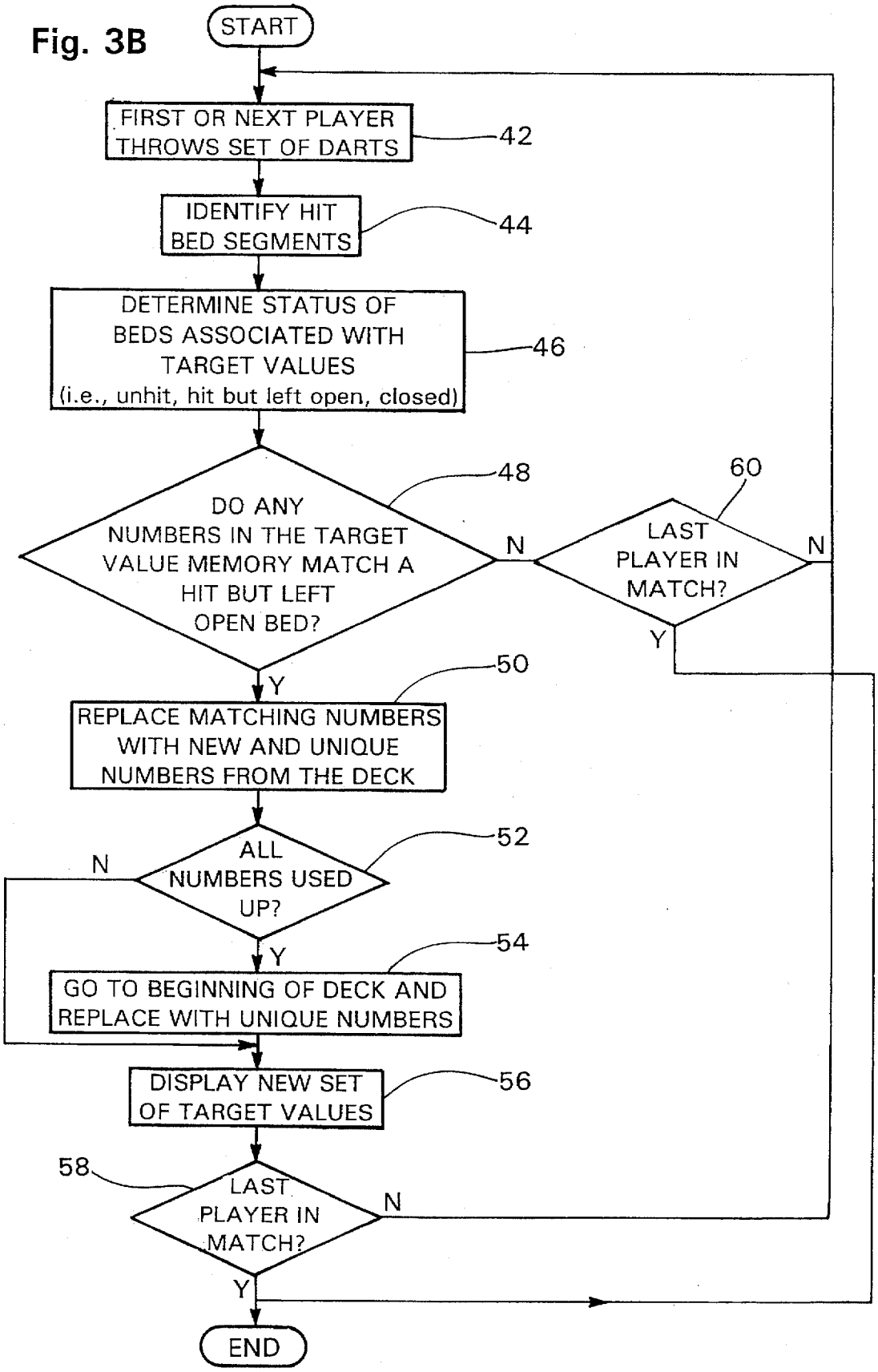

FIG. 2 shows a controller 10 for controlling the play of a game in accordance with the present invention. The controller 10 includes a computer 12 which operates in accordance with a computer program implemented as shown in the flowchart of FIGS. 3A and 3B. The computer 12 receives an input signal from mark detector 14 and may also receive input commands from a user input device 16, such as a keyboard or switch. The mark detector 14 may be any suitable means for identifying target areas of a dart board which have been hit or marked by a dart. The mark detector 14 also identifies which segment of the target area has been hit so that the appropriate number of marks may be tallied for each hit. Dart games which automatically detect which segments have been hit, and which are suitable for use as the mark detector, are well-known in the art. Examples of such dart games are shown and described in U.S. Pat. No. 4,057,251 issued to Jones et al.; U.S. Pat. No. 4,516,781 issued to DeVale et al.; U.S. Pat. No. 4,793,618 issued to Tillery et al.; U.S. Pat. No. 4,881,744 issued to Hansen; U.S. Pat. No. 4,948,148 issued to Danielson; U.S. Pat. No. 4,974,857 issued to Beall et al.; and U.S. Pat. No. 5,116,063 issued to Harlan et al. Such patents describe mark detectors which function by detecting a change in position of switches embedded in the segments. However, other types of mark detectors are within the scope of the invention, such as electromagnetic or optical mark detectors.

The controller 10 also includes a target value memory 18 and a number generator 20, each of which communicate bidirectionally with the computer 12. The target value memory 12 stores the target values for use in the form of Random Cricket played with the present invention. The number generator 20 generates the numbers which are ultimately stored in the memory 18. In the preferred embodiment of the invention, the number generator 20 is a random number generator. However, the scope of the invention includes number generators which generate the numbers in an ordered or pseudorandom manner. Number generators of either type are well-known in the art and thus are not further described herein. The number generator 20 employed herein is of the type which generates a random deck 21 of target numbers upon initialization and then steps a pointer through the deck as subsequent numbers are needed by the computer 12. Other protocols are within the scope of the invention, such as a protocol which generates one random number at a time whenever requested by the computer 12. Another protocol may remove random numbers which are outside of the range of the dart board game. The "range" of the dart board game includes all of the numbers associated with the beds or target areas, normally 1–20. In yet another protocol, the random number generator merely randomizes the order of the numbers 1–20, thereby ensuring that the deck includes every number in the range.

To ensure that previously used numbers are not employed in the same game or match, the computer 12 is provided with a comparator 22. If a previously used number is generated, the comparator 22 causes the number generator 20 to select another number from the deck 21. The comparator 22 also functions to eliminate any numbers which are outside of the range of the dart board game, if any such numbers are in the deck 21. The controller 10 further includes a target value display 24 for displaying the current target values stored in the target value memory 18.

FIGS. 3A and 3B are flowcharts of the operation of the program in the computer 22 for playing a form of Random Cricket in accordance with one preferred embodiment of the present invention. The flowcharts are described in steps 30–60. For convenience, elements in FIG. 2 are referenced as needed in the description below.

FIG. 3A shows a new game routine. When a new game or match begins, the computer 12 causes the random number generator 20 to generate a new deck of random numbers within the range of the dart board numbers (step 30). Typically, this range will be 1–20. The deck pointer of the number generator 20 and the comparator 22 of the computer 12 cooperate to step through the deck 21 until six unique or different numbers within the range of the dart board game are retrieved (steps 32, 34, 36). The six different numbers are stored in the target value memory 18 and displayed on the display 24 (steps 38, 40). In most instances, the current player attempts to hit the beds in the display 24 on their next throw. However, the strategy of the game might dictate another approach, such as trying not to hit one or more of the beds in the display 24.

FIG. 3B shows the game play routine after a player throws his or her set of darts (step 42). The mark detector 14 monitors the hits and identifies the bed segments that were hit (step 44). From the current and past segment hit information, the computer 12 determines which beds have been marked by any player at any time during game play, and which beds have been closed by receiving a total of three marks by darts thrown from the current player or any previous player (step 46). After the player's turn, each bed thus has the status of being either unhit (by any player), hit but left open (i.e., marked, but not closed), or closed (either by the current player or a previous player).

Next, each number in the target value memory 18 is compared to the numbers of the hit but left open beds (step 48). If there is a match, the computer 12 causes the target value to be replaced by a new target value (step 50). The target values of beds which are either unhit or closed (either by the current player or a previous player) do not change. The new target value is the next number in the deck 21 which does not duplicate any numbers currently in the target value memory 18 (step 50). This procedure ensures that during each turn, every current target value is unique. Even a previously used number may be reused as long as it does not duplicate any numbers currently in the target value memory 18. It is even possible that a target value may be replaced by the same target value, since the deck 21 may include duplicate numbers, or the deck 21 may have started a second cycle (steps 52, 54). The new set of target values are then displayed to the players (step 56). When the last player has completed throwing darts, the game ends (steps 58, 60).

The routines shown in FIGS. 3A and 35 merely describe one procedure for performing the present invention. The only necessary result of the routines is that target values which have been marked at least once, but have not been marked more than a preset number of times (e.g., three times), should change to a new target value at a predetermined stage of game play. It is also important that the target values in each current set be different from each other. Other routines which accomplish these functions are within the scope of the invention.

It should thus be understood that the target value becomes unchangeable or fixed only after a bed is closed by any one of the players. If, or when, the beds of all six current target values are fixed, the game progresses in the same manner as Random Cricket.

The scoring routine is not described herein and does not form part of the invention. However, in the preferred embodiment of the invention, the scoring rules of Cricket apply, as described above in the background.

As noted above, the target values of beds which are either unhit or closed (either by the current player or a previous player) do not change. In yet another alternative embodiment of the invention, the target value also does not change for a bed which was hit but left open by a previous player, but which is not marked during the current player's turn.

In still another alternative embodiment of the invention, the game can be modified so that the target values are evaluated for replacement after each dart throw, instead of after each player's turn. That is, steps 44–56 of FIG. 3B would be performed after each dart throw. This embodiment adds an additional element of excitement, strategy and skill to game play.

While not discussed above, it should be understood that there are actually seven target values associated with the dart game of FIG. 2, six replaceable target values and a fixed bullseye.

The present invention adds new strategic and skill elements and greater suspense to the game of Cricket. For example, a player may deliberately cause a number to be changed for a variety of strategic reasons, but must insure that the number is not closed so as not to upset that strategic goal. Greater dart throwing precision is required to hit, but not close, a bed during the player's turn. Additionally, when a number is changed at the end of a turn, the opponents get a first opportunity to shoot for the newly selected target number. Thus, the current player may act as a spoiler if he or she is sufficiently capable of throwing the dart at the proper target. Furthermore, it is possible for a second change to be made on a previously changed number, thereby offering more opportunity for players to strategically close or change each number in accordance with the player's objectives.

Although the present invention is described as being used in a modified version of Random Cricket, the apparatus and method may be employed in other dart game which employ the features of the present invention as part of the rules.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method of controlling a dart game to be played by each of a plurality of players in turn, the dart game having a dart board with a plurality of target areas, each target area corresponding to a target value, and a memory for storing a preset number of target values, the method comprising the steps of:

(a) assigning a first set of target values;

(b) storing the first set of target values in the memory;

(c) identifying at a predetermined stage of game play target values which have been marked at least once by a player, but have not been marked more than a preset number of times by any of the plurality of players;

(d) selecting a replacement target value for each target value identified in step (c), the target value for each target value not identified in step (c) remaining unchanged; and (e) storing the replacement target value for each target value identified in step (c) in the memory in place of the respective first target value.

2. A method of controlling a dart game according to claim 1 wherein the selection in step (d) is performed by a number generator.

3. A method of controlling a dart game according to claim 2 wherein the replacement target values are generated randomly from a predetermined range of numbers.

4. A method of controlling a dart game according to claim 2 wherein step (d) includes determining whether a generated replacement target value is the same as any of the unchanged target values, and if so, selecting a new replacement target value, so that the replacement target values are different from the unchanged target values.

5. A method of controlling a dart game according to claim 1 wherein the dart game is based on Cricket and the preset number of times in step (c) is the number required to close a dart board bed.

6. A method of controlling a dart game according to claim 5 wherein the preset number is three.

7. A method of controlling a dart game according to claim 1 wherein the preset number of target values is six.

8. A method of controlling a dart game according to claim 1, wherein the dart game further includes a display for displaying to the players the target values stored in the memory.

9. A method of controlling a dart game according to claim 1, wherein the predetermined stage of game play is at the end of one player's turn.

10. A method of controlling a dart game according to claim 1, wherein the predetermined stage of game play is after each dart throw.

11. A method of controlling a dart game according to claim 1, wherein step (c) identifies at a predetermined stage of game play target values which have been marked at least once by a current player, but have not been marked more than a preset number of times by any of the plurality of players.

12. A controller for a dart game to be played by each of a plurality of players in turn, the dart game having a dart board including a plurality of target areas, each target area corresponding to a target value, the controller comprising;

(a) a memory for storing a preset number of target values;

(b) a mark detector for identifying at a predetermined stage of game play which target values have been marked at least once by a player, but have not been marked more than a preset number of times by any of the plurality of players; and (c) a number generator for generating a replacement target value for each identified target value, the replacement target value being stored in the memory in place of the respective previous target value, wherein the target value in the memory for each target value not identified by the mark detector remains unchanged.

13. A controller for a dart game according to claim 12 wherein the dart game is based on Cricket and the preset number of times is the number required to close a dart board bed.

14. A controller for a dart game according to claim 13 wherein the preset number of times is three.

15. A controller for a dart game according to claim 12 wherein the number generator generates an initial set of target values.

16. A controller for a dart game according to claim 12 wherein the number generator randomly generates the replacement target values from a predetermined range of numbers.

17. A controller for a dart game according to claim 12 further comprising:

(d) a comparator for determining whether a replacement target value generated by the number generator is the same as any of the unchanged target values, and if so, causing the number generator to generate a new replacement target value, so that the replacement target values are different from the unchanged target values.

18. A controller for a dart game according to claim 12 wherein the preset number of target values is six.

19. A controller for a dart game according to claim 12 further comprising:

(d) a display for displaying to the players the target values stored in the memory.

20. A controller for a dart game according to claim 12 wherein the predetermined stage of game play is at the end of one player's turn.

21. A controller for a dart game according to claim wherein the predetermined stage of game play is after each dart throw.

22. A controller for a dart game according to claim 12 wherein the mark detector identifies which target values have been marked at least once by a current player, but have not been marked more than a preset number of times by any of the plurality of players.

* * * * *